US006638320B2

(12) United States Patent
Angell et al.

(10) Patent No.: US 6,638,320 B2
(45) **Date of Patent: *Oct. 28, 2003**

(54) METHOD OF LAUNDERING FABRICS

(75) Inventors: Adrian John Waynforth Angell, West Chester, OH (US); Les Charles Zorb, Loveland, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/268,437

(22) Filed: Oct. 10, 2002

(65) Prior Publication Data

US 2003/0060394 A1 Mar. 27, 2003

Related U.S. Application Data

(62) Division of application No. 09/674,000, filed as application No. PCT/IB99/00710 on Apr. 21, 1999, now Pat. No. 6,495,509.

(60) Provisional application No. 60/083,264, filed on Apr. 27, 1998.

(51) Int. Cl.[7] ..... D06B 13/00

(52) U.S. Cl. ..... 8/137

(58) Field of Search ..... 510/446, 224, 510/298, 507; 8/137

(56) References Cited

U.S. PATENT DOCUMENTS

| | | | | | |
|---|---|---|---|---|---|
| 3,957,661 | A | * | 5/1976 | Verite | 510/308 |
| 4,472,287 | A | * | 9/1984 | Ramachandran et al. | 252/8.7 |
| 5,658,867 | A | * | 8/1997 | Pancheri et al. | 510/108 |
| 5,731,279 | A | * | 3/1998 | Pancheri | 510/340 |
| 6,174,848 | B1 | * | 1/2001 | Dawson et al. | 510/297 |
| 6,495,509 | B1 | * | 12/2002 | Angell et al. | 510/446 |

FOREIGN PATENT DOCUMENTS

| | | | |
|---|---|---|---|
| GB | 2276345 A | * | 9/1994 |
| WO | WO 98/04662 A1 | * | 2/1998 |

* cited by examiner

*Primary Examiner*—Lorna M. Douyon
(74) *Attorney, Agent, or Firm*—Brahm J. Corstanje; Kim William Zerby; Steven W. Miller

(57) ABSTRACT

A method of laundering fabric materials in a washing machine includes the steps of providing a non-particulate detergent product comprising a mixture of spray-dried detergent and an agglomeration detergent comprising a perborate component, and a flow aid; providing a flexible porous bag for receiving the non-particulate detergent product; placing the non-particulate detergent product within the flexible porous bag containing the detergent product in the washing machine with the fabric materials to be washed.

3 Claims, No Drawings

METHOD OF LAUNDERING FABRICS

CROSS REFERENCE TO RELATED APPLICATIONS

This application is a divisional of Parent application Ser. No. 09/674,000, filed Oct. 25, 2000 now U.S. Pat. No. 6,495,509 which is a 371 of PCT/IB99/00710 filed Apr. 21, 1999 which claims priority under 35 U.S.C. §119 (e) to U.S. filed Provisional application Ser. No. 60/083,264, filed Apr. 27, 1998.

TECHNICAL FIELD

The present invention relates to detergent compositions in non-particulate form. More particularly, the invention relates to a process for improving the dispersibility of a non-particulate detergent composition, e.g., tablet, block or bar, in water, by enabling the manufacture of a non-particulate detergent product that sinks in water and rapidly disintegrates and dissolves in water

BACKGROUND OF THE INVENTION

Non-particulate detergents are an alternative to granular or particulate forms of detergents for simplifying the dosing of such detergents for automatic washing machines, such as laundry or dishwashing machines. Such non-particulate detergents are usually supplied in the form of bars, tablets or briquettes. Such non-particulate detergents not only prevent spillage of the detergent composition but also eliminate the need for the consumer to estimate the correct dosage of the detergent composition per wash. Further, such non-particulate detergents also minimize the contact by the consumer with the detergent.

An important factor for successful performance of a non-particulate detergent is its ability to dissolve in the washing machine in a controlled manner according to a desired dissolution profile during the program cycle of the machine. Another important performance factor is that the non-particulate detergent should be hard enough to facilitate easy handling of the detergent prior to use, so that it does not inadvertently lose its structure, crumble, or deteriorate, both during the packaging, transport and storage and during handling by the end consumer prior to actual use. Such performance aspects are an important feature of the non-particulate detergent, and although they are not necessarily the focus of the present invention, they are inherently a part of the background of the present invention.

Additionally, a very desirable feature of a non-particulate detergent, such as for example, a tablet, is its ability to sink in water and rapidly disperse in water to form a wash solution. In order to sink in water, a detergent tablet must have a density greater than 1000 g/l and in order to disperse in water, a detergent tablet must be able to break up in water. However, when laundry tablets are made from low bulk density detergents, such as those made by spray dried processes, wherein the detergent powder has a bulk density less than about 650 g/l, the problem frequently encountered is that the force required to compact the detergent powder into tablets having a density of at least 1000 g/l is so high that the detergent tablets do not readily disperse in water. This problem is further escalated by the fact that detergent powders made from spray dried processes tend to be more porous and sticky. Thus when these detergent powders are pressed into tablets having a density of at least 1000 g/l, the powder particles stick together and consequently the tablet does not readily break up and dissolve in water. Conversely, if the tablets made from low bulk density detergent powders are compacted using a lower force, they generally disperse in water but at a slower rate because they have a density less than 1000 g/l and thus tend to float in water before fully dispersing in water.

The above problem is usually not encountered when making detergent tablets from a detergent powder made by agglomeration processes because detergent powders made by agglomeration processes usually have a bulk density in a range of about 700 g/l to about 850 g/l and consequently, the force required to compress the powder into a tablet having a density of at least 1000 g/l is not so high. Thus detergent tablets made by compacting detergent powders made from agglomeration process usually sink in water. However, agglomeration process detergents or "agglomerates", which inherently have higher density than spray dried process detergents or "spray dried granules", generally exhibit slower dissolution rates in water, as compared to spray dried granules.

Thus the production of detergent tablets is a complex matter. It involves more than the mere selection of components or the compression of a particular detergent composition into a tablet. The tablet must be capable of withstanding the shocks of packaging, handling and distribution without crumbling. In other words the tablet must be strong. But the tablet must also have a satisfactory rate of disintegration when immersed in water. The tablets known so far have generally shown too long a disintegration time, in favor of their strength, or they have had a very low strength, in favor of their shorter disintegration time.

It is highly desirable to have a laundry detergent tablet with a core which is formed by compressing a particulate material which has a detersive surfactant and a builder and wherein the particulate material is processed in a manner so as to make the individual particles sticky enough to stay together when the material is compressed into a tablet form, yet not too sticky to not disintegrate rapidly when immersed in water. This becomes a very challenging problem in light of the additional desirable requirement that the detergent tablet, after compaction, have a density of at least 1000 g/l so that it sinks in water.

This kind of a tablet performance has heretofore not been available and this level of performance requires not only careful selection of the type of detergent that makes up the core, but also requires novel ways to surface treat the detergent particles prior to compaction so as have just the right amount of stickiness. The present invention overcomes the problems as outlined above.

BACKGROUND ART

The prior art is replete with methods of forming tablets and coating tablets.

One approach has been to use acetate salt to improve the dissolution rate of detergents compressed in the form of tablets. EP-A-0002293, published on Jun. 13, 1979, discloses detergent tablets containing hydrated salt. The preferred hydrate salt is a mixture of sodium acetate trihydrate and sodium metaborate tetrahydrate.

Another approach known in the art is to use effervescent aids to improve tablet disintegration. CA-A-2040307 discloses laundry detergent tablets comprising anionic surfactants mixed with sodium carbonate and citric acid.

As far as coated tablets are concerned, GB-A-0 989 683, published on Apr. 22, 1965, discloses a process for preparing a particulate detergent from surfactants and inorganic salts; spraying on water-soluble silicate; and pressing the detergent particles into a solid form-retaining tablet. Finally a readily water-soluble organic film-forming polymer (for example, polyvinyl alcohol) provides a coating to make the detergent tablet resistant to abrasion and accidental breakage.

European publication, EP-A-0 002 293, published on Jun. 13, 1979, discloses a tablet coating comprising hydrated salt such as acetate, metaborate, orthophosphate, tartrate, and sulphate. Another European publication, EP-A-0 716 144, published on Jun. 12, 1996, also discloses laundry detergent tablets with water-soluble coatings which may be organic polymers including acrylic/maleic co-polymer, polyethylene glycol, PVPVA, and sugar.

SUMMARY OF THE INVENTION

The invention meets the needs above by providing a process for producing a water-dispersible non-particulate detergent product. Specifically, in one aspect of the present invention, the process comprises the step of providing a particulate detergent composition. The process further includes the step of adding a flow aid to the particulate detergent composition in a range of from about 0.1% to about 25% by weight of the particulate detergent composition. The process then includes the step of compacting the particulate detergent composition having the flow aid by applying a pressure in an amount sufficient to form the water-dispersible non-particulate detergent product having a density of at least about 1000 g/l.

In another aspect of the present invention, a method of laundering fabric materials in a washing machine is provided. The method includes the steps of providing a flexible porous bag adapted for receiving a non-particulate detergent product, providing a non-particulate detergent product, placing the non-particulate detergent product within the flexible porous bag, and placing the flexible porous bag containing the detergent product in the washing machine with the fabric materials to be washed. The flexible porous bag is adapted for permitting entry of an aqueous washing medium through the bag, thereby dissolving the non-particulate detergent product placed therein, into the aqueous washing medium, and releasing a resultant wash solution from inside of the bag to outside of the bag and into the aqueous wash medium during a wash cycle.

In yet another aspect of the present invention, a method of laundering soiled clothes includes the step of immersing the soiled clothes in an aqueous medium containing an effective amount of a non-particulate detergent product made by a process which includes the steps of providing a particulate detergent composition, adding a flow aid to the particulate detergent composition in a range of from about 0.1% to about 25% by weight of the particulate detergent composition and compacting the particulate detergent composition having the flow aid by applying a pressure in an amount sufficient to form the water-dispersible non-particulate detergent product having a density of at least about 1000 g/l.

In yet another aspect of the present invention, a water-dispersible non-particulate detergent product is disclosed. The product includes a core formed by compacting a particulate detergent composition to a density of at least about 1000 g/l. The particulate detergent composition has a bulk density in a range of from about 600 g/l to about 850 g/l. The particulate detergent composition comprises a flow aid in a range of from about 0.1% to about 25% by weight of the particulate detergent composition.

DETAILED DESCRIPTION OF THE INVENTION

Process

In the preferred embodiment of the present invention, the process includes the step of providing a particulate detergent composition.

The Particulate Detergent Composition

The term "particulate" as used herein means forms such as powders, granules, particles, flakes and other similar particulate forms that are capable of being compacted into a more dense non-particulate form.

In particular for laundry tablets, detergent particles having ingredients such as builder and surfactant can be spray-dried in a conventional manner and then compacted at a suitable pressure. The surfactants and builders normally provide a substantial part of the cleaning power of the tablet. The term "builder" is intended to mean all materials which tend to remove calcium ion from solution, either by ion exchange, complexation, sequestration or precipitation.

The particulate material used for making the detergent tablet provided in this invention can be made by any particulation or granulation process. An example of such a process is spray drying (in a co-current or counter current spray drying tower) which typically gives "spray-dried" detergent granules having low bulk densities of 600 g/l or lower. Particulate materials of higher density can be prepared by granulation and densification in a high shear batch mixer/granulator or by a continuous granulation and densification process (e.g. using Lodige® CB and/or Lodige® KM mixers). Other suitable processes include fluid bed processes, compaction processes (e.g. roll compaction), extrusion, as well as any particulate material made by any chemical process like flocculation, crystallization sentering, etc. The individual particles can also be in any other form, such as for example, particle, granule, sphere or grain.

The particulate materials may be mixed together by any conventional means, for example, a concrete mixer, Nauta mixer, ribbon mixer or any other. Alternatively the mixing process may be carried out continuously by metering each component by weight on to a moving belt, and blending them in one or more drum(s) or mixer(s). A liquid spray-on to the mix of particulate materials (e.g. non-ionic surfactants) may be carried out. Other liquid ingredients may also be sprayed on to the mix of particulate materials either separately or premixed. For example perfume and slurries of optical brighteners may be sprayed. A finely divided flow aid (dusting agent such as zeolites, carbonates, silicas) can be added to the particulate materials after spraying the non-ionic, preferably towards the end of the process, to make the mix less sticky.

The detergent particles can be made by an agglomerate process comprising the steps of:

i) admixing one or more detergent surfactants, a perborate component and an acid source and optionally other detergent ingredients to form a mixture; and ii) agglomerating the mixture to form agglomerated particles or "agglomerates".

Typically, such an agglomeration process involves mixing an effective amount of powder, including the acid source, with a high active surfactant paste in one or more agglomerators such as a pan agglomerator, a Z-blade mixer or more preferably in-line mixers, preferably two, such as those manufactured by Schugi (Holland) BV, 29 Chroomstraat 8211 AS, Lelystad, Netherlands, and Gebruder Lodige Maschinenbau GmbH, D-4790 Paderborn 1, Elsenerstrasse 7-9, Postfach 2050, Germany. Preferably a high shear mixer is used, such as a Lodige CB (Trade Name). Most preferably, a high shear mixer is used in combination with a low shear mixer, such as a Lodige CB (Trade Name) and a Lodige KM (Trade name) or Schugi KM (Trade Name). Optionally, only one or more tow shear mixer are used. Preferably, the agglomerates are thereafter dried and/or cooled.

Another agglomeration process involves mixing of various components of the final agglomerate in different stages, using a fluidized bed. For example, a preferred particulate detergent in accordance with the present invention can be agglomerated by addition, preferably by spraying on, of nonionic, anionic surfactants and optionally a wax, or mixtures thereof, to the acid source in powdered form and other optional ingredients. Then, additional components, including the perborate bleach and optinally the alkali source or part thereof, can be added and agglomerated in one or more stages, thus forming the final agglomerate particle.

The agglomerates may take the form of flakes, prills, marumes, noodles, ribbons, but preferably take the form of granules. A preferred way to process the particles is by agglomerating powders (e.g. aluminosilicate, carbonate) with high active surfactant pastes and to control the particle size of the resulting agglomerates within specified limits. Typical particle sizes are from 0.10 mm to 5.0 mm in diameter, preferably from 0.25 mm to 3.0 mm in diameter, most preferably from 0.40 mm to 1.00 mm in diameter. Typically, the "agglomerates" have a bulk density desirably, of at least 700 g/l and preferably, in a range of from about 700 g/l to about 900 g/l.

A high active surfactant paste comprising a mix of, typically, from 50% by weight to 95% by weight, preferably 70% by weight to 85% by weight of surfactant, and optionally it can contain an appropriate acid source. The paste may be pumped into the agglomerator at a temperature high enough to maintain a pumpable viscosity, but low enough to avoid degradation of the anionic surfactants used. An operating temperature of the paste of 50° C. to 80° C. is typical. Such pastes and methods for making and processing such pastes is for example described in WO 93/03128. In an especially preferred embodiment of the present invention, the detergent particles made by agglomeration process have a bulk density of greater than about 600 g/l and the detergent is in the form of powder or a granulate.

In the preferred embodiment of the present invention, the particulate detergent composition is a mixture of spray dried process and agglomeration process detergents, such that the final bulk density of the detergent composition is in a range of desirably, no greater than about 900 g/l, more desirably, in a range of from about 600 g/l to about 850 g/l, and preferably, in a range of from about 625 g/l to about 725 g/l. These ranges of bulk density are desirable because if the bulk density of the particulate detergent from which the tablet is to be compressed is greater than about 900 g/l, then the solubility of the detergent tablet will be detrimentally affected. A bulk density less than about 600 g/l is undesirable because at values less than about 600 g/l, the amount of pressure required to form a detergent tablet having a density of at least 1000 g/l is so high that the tablet will not break up easily in water and will not dissolve rapidly.

To achieve the desired bulk densities as set forth above, the particulate detergent composition contains selected amounts of spray dried granules and detergent agglomerates in an optimum proportion. In this regard, the composition comprises desirably from about 40% to about 80%, preferably from about 40% to about 60%, and more preferably from about 45% to about 55%, by weight, of spray dried. Desirably, the composition includes from about 20% to about 60%, preferably from about 40% to about 60%, and more preferably from about 45% to about 55%, by weight, of agglomerates.

Dry Detergent Material

The starting dry detergent material of the present process preferably comprises materials selected from the group consisting of carbonates, sulfates, carbonate/sulfate complexes, tripolyphosphates, tetrasodium pyrophosphate, citrates, aluminosilicates, cellulose-based materials and organic synthetic polymeric absorbent gelling materials. More preferably, the dry detergent material is selected from the group consisting of aluminosilicates, carbonates, sulfates, carbonate/sulfate complexes, and mixtures thereof. Most preferably, the dry detergent material comprise a detergent aluminosilicate builder which are referenced as aluminosilicate ion exchange materials and sodium carbonate.

The aluminosilicate ion exchange materials used herein as a detergent builder preferably have both a high calcium ion exchange capacity and a high exchange rate. Without intending to be limited by theory, it is believed that such high calcium ion exchange rate and capacity are a function of several interrelated factors which derive from the method by which the aluminosilicate ion exchange material is produced. In that regard, the aluminosilicate ion exchange materials used herein are preferably produced in accordance with Corkill et al, U.S. Pat. No. 4,605,509 (Procter & Gamble), the disclosure of which is incorporated herein by reference.

Preferably, the aluminosilicate ion exchange material is in "sodium" form since the potassium and hydrogen forms of the instant aluminosilicate do not exhibit the as high of an exchange rate and capacity as provided by the sodium form. Additionally, the aluminosilicate ion exchange material preferably is in over dried form so as to facilitate production of crisp detergent agglomerates as described herein. The aluminosilicate ion exchange materials used herein preferably have particle size diameters which optimize their effectiveness as detergent builders. The term "particle size diameter" as used herein represents the average particle size diameter of a given aluminosilicate ion exchange material as determined by conventional analytical techniques, such as microscopic determination and scanning electron microscope (SEM). The preferred particle size diameter of the aluminosilicate is from about 0.1 micron to about 10 microns, more preferably from about 0.5 microns to about 9 microns. Most preferably, the particle size diameter is from about 1 microns to about 8 microns.

Preferably, the aluminosilicate ion exchange material has the formula $$Na_z[(AlO_2)_z.(SiO_2)_y]xH_2O$$

wherein z and y are integers of at least 6, the molar ratio of z to y is from about 1 to about 5 and x is from about 10 to about 264. More preferably, the aluminosilicate has the formula $$Na_{12}[(AlO_2)_{12}.(SiO_2)_{12}]xH_2O$$

wherein x is from about 20 to about 30, preferably about 27. These preferred aluminosilicates are available commercially, for example under designations Zeolite A, Zeolite B and Zeolite X. Alternatively, naturally-occurring or synthetically derived aluminosilicate ion exchange materials suitable for use herein can be made as described in Krummel et al, U.S. Pat. No. 3,985,669, the disclosure of which is incorporated herein by reference.

The aluminosilicates used herein are further characterized by their ion exchange capacity which is at least about 200 mg equivalent of $CaCO_3$ hardness/gram, calculated on an anhydrous basis, and which is preferably in a range from about 300 to 352 mg equivalent of $CaCO_3$ hardness/gram. Additionally, the instant aluminosilicate ion exchange materials are still further characterized by their calcium ion exchange rate which is at least about 2 grains $Ca^{++}$/gallon/minute/-gram/gallon, and more preferably in a range from about 2 grains $Ca^{++}$/gallon/minute/-gram/gallon to about 6 grains $Ca^{++}$/gallon/minute/-gram/gallon.

Additionally, those builder materials discussed previously as an optional coating agent can be used herein. These particular builder materials have the formula $(M_x)_iCa_y(CO_3)_z$ wherein x and i are integers from 1 to 15, y is an integer from 1 to 10, z is an integer from 2 to 25, $M_i$ are cations, at least one of which is a water-soluble, and the equation $\Sigma_i=_{1-15}(x_i$ multiplied by the valence of $M_i)+2y=2z$ is satisfied such that the formula has a neutral or "balanced" charge. Additional details and examples of these builder materials have been set forth previously and are incorporated herein by reference. Preferably, these builder materials are selected from the group consisting of $Na_2Ca(CO_3)_2$, $K_2Ca(CO_3)_2$, $Na_2Ca_2(CO_3)_3$, $NaKCa(CO_3)_2$, $NaKCa_2(CO_3)_3$, $K_2Ca_2(CO_3)_3$, and combinations thereof.

Adjunct Detergent Ingredients

The starting dry detergent material in the present process can include additional detergent ingredients and/or, any number of additional ingredients can be incorporated in the detergent composition during subsequent steps of the present process. These adjunct ingredients include other detergency builders, bleaches, bleach activators, suds boosters or suds suppressers, anti-tarnish and anticorrosion agents, soil suspending agents, soil release agents, germicides, pH adjusting agents, non-builder alkalinity sources, chelating agents, smectite clays, enzymes, enzyme-stabilizing agents and perfumes. See U.S. Pat. No. 3,936,537, issued Feb. 3, 1976 to Baskerville, Jr. et al., incorporated herein by reference.

Other builders can be generally selected from the various water-soluble, alkali metal, ammonium or substituted ammonium phosphates, polyphosphates, phosphonates, polyphosphonates, carbonates, borates, polyhydroxy sulfonates, polyacetates, carboxylates, and polycarboxylates. Preferred are the alkali metal, especially sodium, salts of the above. Preferred for use herein are the phosphates, carbonates, $C_{10-18}$ fatty acids, polycarboxylates, and mixtures thereof. More preferred are sodium tripolyphosphate, tetrasodium pyrophosphate, citrate, tartrate mono- and di-succinates, and mixtures thereof (see below).

In comparison with amorphous sodium silicates, crystalline layered sodium silicates exhibit a clearly increased calcium and magnesium ion exchange capacity. In addition, the layered sodium silicates prefer magnesium ions over calcium ions, a feature necessary to insure that substantially all of the "hardness" is removed from the wash water. These crystalline layered sodium silicates, however, are generally more expensive than amorphous silicates as well as other builders. Accordingly, in order to provide an economically feasible laundry detergent, the proportion of crystalline layered sodium silicates used must be determined judiciously.

The crystalline layered sodium silicates suitable for use herein preferably have the formula $$NaMSi_xO_{2x+1}.yH_2O$$

wherein M is sodium or hydrogen, x is from about 1.9 to about 4 and y is from about 0 to about 20. More preferably, the crystalline layered sodium silicate has the formula $$NaMSi_2O_5.yH_2O$$

wherein M is sodium or hydrogen, and y is from about 0 to about 20. These and other crystalline layered sodium silicates are discussed in Corkill et al, U.S. Pat. No. 4,605,509, previously incorporated herein by reference.

Specific examples of inorganic phosphate builders are sodium and potassium tripolyphosphate, pyrophosphate, polymeric metaphosphate having a degree of polymerization of from about 6 to 21, and orthophosphates. Examples of polyphosphonate builders are the sodium and potassium salts of ethylene diphosphonic acid, the sodium and potassium salts of ethane 1-hydroxy-1, 1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137; 3,400,176 and 3,400,148, all of which are incorporated herein by reference.

Examples of nonphosphorus, inorganic builders are tetraborate decahydrate and silicates having a weight ratio of $SiO_2$ to alkali metal oxide of from about 0.5 to about 4.0, preferably from about 1.0 to about 2.4. Water-soluble, nonphosphorus organic builders useful herein include the various alkali metal, ammonium and substituted ammonium polyacetates, carboxylates, polycarboxylates and polyhydroxy sulfonates. Examples of polyacetate and polycarboxylate builders are the sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Polymeric polycarboxylate builders are set forth in U.S. Pat. No. 3,308,067, Diehl, issued Mar. 7, 1967, the disclosure of which is incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylene malonic acid. Some of these materials are useful as the water-soluble anionic polymer as hereinafter described, but only if in intimate admixture with the non-soap anionic surfactant.

Other suitable polycarboxylates for use herein are the polyacetal carboxylates described in U.S. Pat. No. 4,144,226, issued Mar. 13, 1979 to Crutchfield et al, and U.S. Pat. No. 4,246,495, issued Mar. 27, 1979 to Crutchfield et al, both of which are incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a detergent composition. Particularly preferred polycarboxylate builders are the ether carboxylate builder compositions comprising a combination of tartrate monosuccinate and tartrate disuccinate described in U.S. Pat. No. 4,663,071, Bush et al., issued May 5, 1987, the disclosure of which is incorporated herein by reference.

Bleaching agents and activators are described in U.S. Pat. No. 4,412,934, Chung et al., issued Nov. 1, 1983, and in U.S.

Pat. No. 4,483,781, Hartman, issued Nov. 20, 1984, both of which are incorporated herein by reference. Chelating agents are also described in U.S. Pat. No. 4,663,071, Bush et al., from Column 17, line 54 through Column 18, line 68, incorporated herein by reference. Suds modifiers are also optional ingredients and are described in U.S. Pat. No. 3,933,672, issued Jan. 20, 1976 to Bartoletta et al., and U.S. Pat. No. 4,136,045, issued Jan. 23, 1979 to Gault et al., both incorporated herein by reference.

Suitable smectite clays for use herein are described in U.S. Pat. No. 4,762,645, Tucker et al, issued Aug. 9, 1988, Column 6, line 3 through Column 7, line 24, incorporated herein by reference. Suitable additional detergency builders for use herein are enumerated in the Baskerville patent, Column 13, line 54 through Column 16, line 16, and in U.S. Pat. No. 4,663,071, Bush et al, issued May 5, 1987, both incorporated herein by reference.

The Non-Particulate Detergent Product

The detergent tablets can be prepared simply by mixing the solid ingredients together and compressing the mixture in a conventional tablet press as used, for example, in the pharmaceutical industry.

The detergent tablets provided can be made in any size or shape and are desirably surface treated with a flow aid according to the present invention. The detergent tablets provided may be manufactured by using any compacting process, such as tabletting, briquetting, or extrusion, preferably tabletting. Suitable equipment includes a standard single stroke or a rotary press (such as Courtoy®, Korch®, Manesty®, or Bonals®). As used herein, the term "non-particulate detergent product" includes physical shapes such as tablets, blocks, bars and the like.

Coating for Non-Particulate Detergent Product

In one embodiment, the tablets are coated with a coating in order to provide mechanical strength and shock and chip resistance to the compressed tablet core. The tablets are coated with a coating that is substantially insoluble in water so that the tablet does not absorb moisture, or absorbs moisture at only a very slow rate. The coating is strong so that moderate mechanical shocks to which the tablets are subjected during handling, packing and shipping result in no more than very low levels of breakage or attrition. Further, the coating is preferably brittle so that the tablet breaks up when subjected to stronger mechanical shock. Furthermore it is advantageous if the coating material is dissolved under alkaline conditions, or is readily emulsified by surfactants. This avoids the deposition of undissolved particles or lumps of coating material on the laundry load. This may be important when the coating material is completely insoluble (for example less than 1 g/l) in water.

As defined herein "substantially insoluble" means having a very low solubility in water. This should be understood to mean having a solubility in water at 25° C. of less than 20 g/L, preferably less than 5 g/l, and more preferably less than 1 g/l. Water solubility is measured following the test protocol of ASTM E1148-87 entitled, "Standard Test Method for Measurements of Aqueous Solubility".

Suitable coating materials are fatty acids, adipic acid and C8–C13 dicarboxylic acids, fatty alcohols, diols, esters and ethers. Preferred fatty acids are those having a carbon chain length of from C12 to C22 and most preferably from C18 to C22. Preferred dicarboxylic acids are adipic acid (C6), suberic acid (C8), azelaic acid (C9), sebacic acid (C10), undecanedioic acid (C11), dodecanedioic acid (C12) and tridecanedioic acid (C13). Preferred fatty alcohols are those having a carbon chain length of from C12 to C22 and most preferably from C14 to C18. Preferred diols are 1,2-octadecanediol and 1,2-hexadecanediol. Preferred esters are tristearin, tripalmitin, methylbehenate, ethylstearate. Preferred ethers are diethyleneglycol mono hexadecylether, diethyleneglycol mono octadecylether, diethyleneglycol mono tetradecylether, phenylether, ethyl naphtyl ether, 2 methoxynaphtalene, beta naphtyl methyl ether and glycerol monooctadecylether. Other preferred coating materials include dimethyl 2,2 propanol, 2 hexadecanol, 2 octadecanone, 2 hexadecanone, 2, 15 hexadecanedione and 2 hydroxybenzyl alcohol. The coating is a hydrophobic material having a melting point preferably of from 40° C. to 180° C.

In the preferred embodiment, the coating can be applied in a number of ways. Two preferred coating methods are a) coating with a molten material and b) coating with a solution of the material. In a), the coating material is applied at a temperature above its melting point, and solidifies on the tablet. In b), the coating is applied as a solution, the solvent being dried to leave a coherent coating. The substantially insoluble material can be applied to the tablet by, for example, spraying or dipping. Normally when the molten material is sprayed on to the tablet, it will rapidly solidify to form a coherent coating. When tablets are dipped into the molten material and then removed, the rapid cooling again causes rapid solidification of the coating material. Clearly substantially insoluble materials having a melting point below 40° C. are not sufficiently solid at ambient temperatures and it has been found that materials having a melting point above about 180° C. are not practicable to use. Preferably, the materials melt in the range from 60° C. to 160° C., more preferably from 70° C. to 120° C.

By "melting point" is meant the temperature at which the material when heated slowly in, for example, a capillary tube becomes a clear liquid. For most purposes, the coating forms from 1% to 10%, preferably from 1.5% to 5%, of the tablet weight.

Addition of Flow Aids

In the preferred embodiment, the process further includes the step of adding a flow aid to the particulate detergent composition in a range of from about 0.1% to about 25% by weight of the particulate detergent composition.

As used herein, the term "flow aids" means any material capable of being deposited on to the surface of detergent particles so as to reduce the stickiness of the detergent particles and allow them to flow freely. Flow aids could include porous carrier particles selected from the group consisting of amorphous silicates, crystalline nonlayer silicates, layer silicates, calcium carbonates, calcium/sodium carbonate double salts, sodium carbonates, clays, zeolites, sodalites, alkali metal phosphates, macroporous zeolites, chitin microbeads, carboxyalkylcelluloses, carboxyalkylstarches, cyclodextrins, porous starches and mixtures thereof.

The preferred flow aids are zeolite A, zeolite X, zeolite Y, zeolite P, zeolite MAP and mixtures thereof. The term "zeolite" used herein refers to a crystalline aluminosilicate material. The structural formula of a zeolite is based on the crystal unit cell, the smallest unit of structure represented by $$Mm/n[(AlO2)m(SiO2)y].xH2O$$

where n is the valence of the cation M, x is the number of water molecules per unit cell, m and y are the total number of tetrahedra per unit cell, and y/m is 1 to 100. Most preferably, y/m is 1 to 5. The cation M can be Group IA and Group IIA elements, such as sodium, potassium, magnesium, and calcium.

In the preferred embodiment of the present invention, the flow aid is added in an amount in a range, desirably, from about 0.1% to about 25% by weight of the particulate detergent, more desirably from about 1% to about 15% by weight, preferably from about 1% to about 10% by weight, and most preferably in an amount of about 5% by weight. It is undesirable to add more than 25% by weight of the flow aid because too excessive a force would be needed to make the detergent particles to stick together and stay in a particulate form. Flow aid addition in an amount less than about 0.1% by weight is also undesirable because little or no reduction in the stickiness of the detergent particles would occur, which upon compression into a particulate form would cause the resultant detergent tablet to not disintegrate readily when placed in water in a washing machine.

In one embodiment, the flow aids have a perfume adsorbed on their surface before being deposited on the detergent particles. Preferably, the flow aids are zeolites preferably containing less than about 20% desorbable water, more preferably less than about 8% desorbable water, and most preferably less than about 5% desorbable water. Such materials may be obtained by first activating/dehydrating by heating to about 150° to 350° C., optionally with reduced pressure (from about 0.001 to about 20 Torr). After activation, the perfume is slowly and thoroughly mixed with the activated zeolite and, optionally, heated to about 60° C. for up to about 2 hours to accelerate absorption equilibrium within the zeolite particles. The perfume/zeolite mixture is then cooled to room temperature and is in the form of a free-flowing powder. The term "perfume" is used to indicate any odoriferous material which is subsequently released into the aqueous bath and/or onto fabrics contacted therewith. The perfume will most often be liquid at ambient temperatures. A wide variety of chemicals are known for perfume uses, including materials such as aldehydes, ketones and esters. More commonly, naturally occurring plant and animal oils and exudates comprising complex mixtures of various chemical components are known for use as perfumes. The perfumes herein can be relatively simple in their compositions or can comprise highly sophisticated complex mixtures of natural and synthetic chemical components, all chosen to provide any desired odor. Typical perfumes can comprise, for example, woody/earthy bases containing exotic materials such as sandalwood, civet and patchouli oil. The perfumes can be of a light floral fragrance, e.g., rose extract, violet extract, and lilac. The perfumes can also be formulated to provide desirable fruity odors, e.g., lime, lemon, and orange. Any chemically compatible material which exudes a pleasant or otherwise desirable odor can be used in the perfumed compositions herein. Perfumes also include pro-fragrances such as acetal pro-fragrances, ketal pro-fragrances, ester pro-fragrances (e.g., digeranyl succinate), hydrolyzable inorganic-organic pro-fragrances, and mixtures thereof. These pro-fragrances may release the perfume material as a result of simple hydrolysis, or may be ph-change-triggered pro-fragrances (e.g., pH drop) or may be enzymatically releasable pro-fragrances.

In the preferred embodiment, the amount of perfume adsorbed on the carrier material, such as zeolite for example, is preferably in the range of about 0.1% to about 50% by weight, more preferably in the range of about 0.5% to about 25% by weight, and most preferably in the range of about 1% to about 15% by weight of zeolite powder.

Compaction of Particulate Detergent to Form Non-Particulate Detergent Product In the preferred embodiment, the process still further includes the step of compacting the particulate detergent composition having the flow aid by applying a pressure in an amount sufficient to form the water-dispersible non-particulate detergent product having a density of at least about 1000 g/l. It is desirable to form a detergent tablet that has a density of at least about 1000 g/l so that the tablet will sink in water. If the density of the detergent tablet is less than about 1000 g/l, the tablet will float when placed in the water in a washing machine and this will detrimentally reduce the dissolution rate of the tablet in the water. It is desirable to apply at least that much pressure as is sufficient to compress the particulate detergent material to form a tablet having a density of at least about 1000 g/l. Too little a pressure will result in a compressed tablet with a density less than about 1000 g/l.

EXAMPLE A

Detergent tablets are formed which have a flow aid deposited on the detergent particles before such particles are compressed into a tablet form, according to the following composition:

TABLE A.1

| Ingredients | % by weight |
|---|---|
| Detergent particles | 95.00 |
| Flow Aid (zeolite A) | 5.00 |
| Total | 100.00 |

The detergent particles have the following composition:

TABLE A.2

| Particulate detergent Ingredients | % by weight |
|---|---|
| $C_{12-16}$ linear alkylbenzene sulfonate | 8.80 |
| $C_{14-15}$ alkyl sulfate/$C_{14-15}$ alkyl ethoxy sulfate | 8.31 |
| $C_{12-13}$ alkyl ethoxylate | 1.76 |
| polyacrylate (MW = 4500) | 2.40 |
| polyethylene glycol (MW = 4000) | 0.96 |
| sodium sulfate | 8.40 |
| aluminosilicate | 21.28 |
| sodium carbonate | 16.80 |
| protease enzyme | 0.32 |
| sodium perborate monohydrate | 2.08 |
| lipase enzyme | 0.17 |
| cellulase enzyme | 0.08 |
| NOBS extrudate | 4.80 |
| citric acid monohydrate | 2.25 |
| sodium bicarbonate | 2.75 |
| sodium acetate | 15.00 |
| free water | 1.60 |
| other minor ingredients (perfume etc.) | 2.24 |
| Total | 100.00 |

The detergent tablet formed is coated with a coating according to the following composition:

TABLE A.3

| Ingredient | % by weight |
|---|---|
| Detergent tablet having flow aid | 91.10 |
| Coating: | |
| dodecanedioc acid | 8.00 |
| carboxymethyl cellulose | 0.90 |
| Total | 100.00 |

The flow aid (zeolite) is added to the particulate detergent composition and mixed by one of various methods, such as agitation for example, in order to homogeneously mix the flow aid with the detergent composition. Alternatively, the flow aid is sprayed on the surface of detergent particle.

The tablets are formed by compressing the tablet ingredients in a cylindrical die having a diameter of 55 mm using a laboratory press having a trade name Carver Model 3912, to form a tablet having a height of 20 mm. The formed tablets were then coated with the protective coating by dipping the tablet into a molten bath of the coating for about 3 seconds. The molten coating bath is maintained at a temperature of about 145 degrees centigrade.

The term "NOBS extrudate" as used herein, is an acronym for the chemical sodium nonanoyloxybenzene sulfonate, commercially available from Eastman Chemicals, Inc. The carboxymethyl cellulose used in the above example is commercially available from Metsa-Serla and sold under the trade name, Nymcel ZSB-16.

Test for Determining Dispersibility in Water

The following method is used to measure the rate of dispersion (ROD) of a detergent tablet expressed as percentage residue remaining after "t" minutes, where "t" is 3, 5 and 10 minutes. The equipment used includes a 5000 ml glass beaker, a stopwatch with alarm, an electrical stirrer with variable speed IKA RW 20 DZM or equivalent, a cage made of perforated metal gauze (diameter 52 mm, height 40 mm having 16 apertures each of about 2.5 mm square) and a weigh scale with accuracy of 0.1 grams.

The method includes the following steps: The beaker is filled with 4000 ml (+/−50 ml) of distilled water at 20° C. (+/−1° C.). The cage tester is mounted in the electrical stirrer. A tablet with a known weight is placed in the cage and the cage is connected to the stirrer. The cage is submerged in the water with the cage suspended about half way down the beaker and the stirrer is started at a fixed speed of 80 rpm. The stopwatch is started. The stirrer is stopped after 3 minutes. The cage is lifted out of the water and the tablet residue remaining in the cage is weighed. The % residue is calculated with the following equation:

$$\%\ \text{residue} = \frac{\text{Tablet weight after "}t\text{" minutes}}{\text{Initial tablet weight}} \times 100$$

The remaining tablet is placed back in the cage and the process is repeated for an additional 2 and 5 minutes to give yield data for tablet dispersion after 3, 5 and 10 minutes.

As used herein, the term "dispersibility in water" is defined as a measure of the % residue, as calculated above, after 3 minutes. In other words, for example, a detergent tablet which has 5% by weight less residue than another detergent tablet would be deemed to have 5% greater dispersibility in water.

It has been unexpected and surprisingly discovered that the non-particulate detergent product, e.g., a detergent tablet, has at least about 5% greater dispersability in water as compared to another non-particulate detergent product having a density of at least about 1000 g/l but not formulated with a flow aid according to this invention. It has also been unexpectedly found that the water-dispersible non-particulate detergent product has at least about 10% greater dispersability in water as compared to a non-particulate detergent product having a density of at least about 1000 g/l and having a flow aid in an amount less than about 1% by weight of the particulate detergent composition.

It has also been discovered that the water-dispersible non-particulate detergent product formed by the process of the present invention has at least about 25% greater dispersability in water as compared to a non-particulate detergent product having a density of at least about 1000 g/l and having a flow aid in an amount less than about 2% by weight of the particulate detergent composition.

In the preferred embodiment of the present invention, the flow aid is added in an amount of about 5% by weight of the particulate detergent composition. It has been unexpectedly discovered that by doing so, the water-dispersible non-particulate detergent product of the present invention has at least about 50% greater dispersability in water as compared to another non-particulate detergent product having a density of at least about 1000 g/l and having the flow aid in an amount less than about 5% by weight of the particulate detergent composition.

In another embodiment of the present invention, a method of laundering fabric materials in a washing machine includes the steps of providing a flexible porous bag adapted for receiving a non-particulate detergent product, providing a non-particulate detergent product, placing the non-particulate detergent product within the flexible porous bag, and placing the flexible porous bag containing the detergent product in the washing machine with the fabric materials to be washed.

The flexible porous bag is permeable to water and to the washing medium and is thus adapted for permitting entry of an aqueous washing medium through the bag, thereby dissolving the non-particulate detergent product placed therein, into the aqueous washing medium, and releasing a resultant wash solution from inside of the bag to outside of the bag and into the aqueous wash medium during a wash cycle.

The flexible porous bag is made of a material capable of retaining the non-particulate detergent product without allowing it to pass through until the detergent product has dissolved in the washing medium. The bag is also made of a material capable of withstanding the temperatures of washing laundry in a washing machine. The process of the invention may be applied not only to non-particulate detergents but also to any non-particulate product which is active during washing, such as, for example, bleaching agents, such as agents releasing chlorine or active oxygen (peroxygen compounds), bleaching catalysts, bleaching activators, bactericides, foam regulators, whiteners, agents preventing the re-deposition of soil, enzymes, softeners, agents capable of removing grease stains or other constituents having no direct effect on the soiling but capable of taking part in the laundry washing process.

The flexible bag may be made from any material which offers a sufficient resistance to water, such as a woven or non-woven material produced from natural or synthetic fibers. For example, the bag is formed of pure cotton either in the form of a fabric with a mesh opening of less than about 0.5 mm or in the form of a non-woven article with openings having a size in a range of from about 0.5 mm to about 0.8 mm.

Accordingly, having thus described the invention in detail, it will be obvious to those skilled in the art that various changes may be made without departing from the scope of the invention and the invention is not to be considered limited to what is described in the specification.

What is claimed is:

1. A method of laundering fabric materials in a washing machine, comprising the steps of:

(a) providing a particulate detergent composition, wherein said particulate detergent composition is a mixture of a spray dried detergent and an agglomeration detergent comprising a perborate component present in a weight ratio in a range of from about 40:60 to about 80:20, spray dried:agglomeration detergent, the final bulk density of said detergent composition being no greater than about 900 g/l;

(b) adding a flow aid to said particulate detergent composition in a range from about 0.1% to about 25% by weight of said particulate detergent composition;

(c) compacting said particulate detergent composition having said flow aid by applying a pressure in an amount sufficient to form a water-dispersible non-particulate detergent product having a density of at least about 1000 g/l;

(d) providing a flexible porous bag adapted for receiving the non-particulate detergent product;

(e) placing said non-particulate detergent product within said flexible porous bag;

(f) placing said flexible porous bag containing said detergent product in said washing machine with said fabric materials to be washed;

wherein the flexible porous bag is adapted for permitting entry of an aqueous washing medium through said bag, thereby dissolving said non-particulate detergent product placed therein, into said aqueous washing medium, and releasing a resultant wash solution from inside of the bag to outside of the bag into said aqueous wash medium during a wash cycle.

2. The method of claim 1 wherein said water-dispersible non-particulate detergent product has at least about 5% greater dispersability in water as compared to another non-particulate detergent product having a density of at least about 1000 g/l but not having said flow aid.

3. The method of claim 1 wherein said flow aid is a zeolite selected from the group consisting of Zeolite A, Zeolite X, Zeolite Y, Zeolite P, Zeolite MAP, and mixtures thereof.

* * * * *